US007438131B2

(12) United States Patent
Weirich

(10) Patent No.: US 7,438,131 B2
(45) Date of Patent: Oct. 21, 2008

(54) EXPANDABLE INJECTOR PIPE

(75) Inventor: John B. Weirich, Stavanger (NO)

(73) Assignee: Baker Hughes Incorporated, Houston, TX (US)

( * ) Notice: Subject to any disclaimer, the term of this patent is extended or adjusted under 35 U.S.C. 154(b) by 217 days.

(21) Appl. No.: 11/196,909

(22) Filed: Aug. 4, 2005

(65) Prior Publication Data

US 2006/0027370 A1 Feb. 9, 2006

Related U.S. Application Data

(60) Provisional application No. 60/599,415, filed on Aug. 6, 2004.

(51) Int. Cl.
*E21B 34/08* (2006.01)
*F16K 15/14* (2006.01)

(52) U.S. Cl. ..... 166/326; 166/236; 166/386; 137/853

(58) Field of Classification Search ..... 166/386, 166/326, 227, 236, 50, 313, 207, 208; 251/65.1; 137/853, 496, 505.25, 505.26, 508, 512.4, 137/516.11, 849
See application file for complete search history.

(56) References Cited

U.S. PATENT DOCUMENTS 1,384,305 A * 7/1921 Crotto ..... 166/141
1,667,649 A * 4/1928 Boynton ..... 166/193
1,854,518 A * 4/1932 Little ..... 137/516.15
2,391,605 A * 12/1945 Walton ..... 417/113
2,657,899 A * 11/1953 Kohler et al. ..... 137/516.11
3,638,726 A * 2/1972 Sibley ..... 166/236
3,722,854 A * 3/1973 Parola ..... 251/127
6,530,431 B1 * 3/2003 Castano-Mears et al. .... 166/381
6,978,840 B2 * 12/2005 Henderson ..... 166/380
7,152,687 B2 * 12/2006 Gano ..... 166/386

FOREIGN PATENT DOCUMENTS

JP 08165640 A * 6/1996

* cited by examiner

*Primary Examiner*—Kenneth Thompson
(74) *Attorney, Agent, or Firm*—Steve Rosenblatt

(57) ABSTRACT

An expandable injector pipe has openings and a cover sleeve preferably secured at opposed ends with offset openings. Expansion of the base pipe causes the cover sleeve to expand while keeping the openings in the cover sleeve misaligned with the openings in the base pipe. Pressure from within the base pipe flexes the resilient cover sleeve to allow fluid to exit through the cover sleeve. Upon removal of applied pressure, the cover sleeve moves back against the base pipe to cover the openings in the base pipe to prevent flow in the reverse direction.

20 Claims, 4 Drawing Sheets

EXPANDABLE INJECTOR PIPE

PRIORITY INFORMATION

This application claims the benefit of U.S. Provisional Application No. 60/599,415, filed on Aug. 6, 2004.

FIELD OF THE INVENTION

The field of this invention relates to downhole expandable tubulars with openings that permit one-way flow.

BACKGROUND OF THE INVENTION

In wells that are used to accept the injection of materials, typically water, gas, steam, drill cuttings, or wastes, the injected zone will often become destabilized. The destabilization can be due to one or a combination of but not limited to injection pressures, injection velocities, or dissolution of in situ cementing minerals. When injection is halted, either temporarily or permanently, the destabilized zone can fall apart and cause formation material, typically sand, to enter the wellbore. Having this material enter the wellbore is an undesirable effect as the material can fill the wellbore completely, closing it off. The invading material can plug downhole components or give rise to erosion of components if the material becomes entrained in a flow stream.

A common method to control the influx of formation material into a wellbore is to employ the technique of gravel packing with a slotted liner or well screen, or to install pre-/drilled pipe, slotted liners, or well screens on their own without a gravel pack. These techniques can be effective in controlling formation sand influx, but have drawbacks in that the gravel from a gravel pack can itself become injected into the formation, or subjected to dissolution, and the slotted liners or well screens can become eroded and lose their formation sand retention capabilities. Erosion becomes an even greater concern if the type and quantity of the entrained fines in the injection material is unknown or is difficult to control.

Wells where the nature of the injected material is unknown is in wells that produce water from one zone and where it is desirable to inject the produced water into another zone in the wellbore to stimulate production through an entirely different well communicated with the injection zone. One way to do this is to take the produced water from one zone and use a downhole pump to obtain the desired injection pressure and deliver the produced water to the injection zone. The injection zone is typically isolated from the water-producing zone so that the pressurized water is directed entirely into the injection zone.

The water that is produced can have fines entrained in it, typically sand. Screens and gravel packing can reduce some of the production of sand but some will get through. In view of the fact that a downhole pump will elevate the produced water pressure and necessarily increase its velocity, there exists a danger of damage to screens that may be provided in the injection zone from high water velocities with entrained solids. The injection zone may need gravel packing for a later time when it goes into production through the injection wellbore. Additionally, the injection of water from another zone is not always a continuous process. During times when the injection flow is halted the flow direction in the injection zone can reverse and that zone can start to produce before injection is complete from that borehole. It is desirable to prevent such flow back when the water injection flow is interrupted.

If the produced water from the zone below has entrained fines it can cut a screen around the injection zone of that same borehole. Interruption of the injection flow needs to be coupled with preventing production until the injection process is completed. The present invention addresses these needs. By incorporating expansion a large borehole drift dimension is provided and the injection process in enhanced. Reverse flow upon interruption of injection is prevented.

In the past, traditional techniques of gravel packing have involved using a crossover to deliver the gravel to an annular space around a screen by directing the gravel flow through a ported sub that had a solid resilient cover sleeve attached at one end to the sub and having a free opposite end. The pumped gravel displaced the loose end away from the sub to let the gravel pass. When the gravel flow stopped the resilient sleeve relaxed back to cover the ports in the sub to keep gravel from coming back. The technique did not encompass expansion and its use was limited to gravel deposition. The tool was made by Eclipse Packer Company and may have been developed by Phillip Barbee. Eclipse was incorporated into Weatherford Inc. in 2003.

Those skilled in the art will better appreciate the various aspects of the invention from the description of the preferred embodiment and the claims that appear below.

SUMMARY OF THE INVENTION

An expandable injector pipe has openings and a cover sleeve preferably secured at opposed ends with offset openings. Expansion of the base pipe causes the cover sleeve to expand while keeping the openings in the cover sleeve misaligned with the openings in the base pipe. Pressure from within the base pipe flexes the resilient cover sleeve to allow fluid to exit through the cover sleeve. Upon removal of applied pressure, the cover sleeve moves back against the base pipe to cover the openings in the base pipe to prevent flow in the reverse direction.

DETAILED DESCRIPTION OF THE DRAWINGS

DETAILED DESCRIPTION OF THE PREFERRED EMBODIMENT

Figure 1:
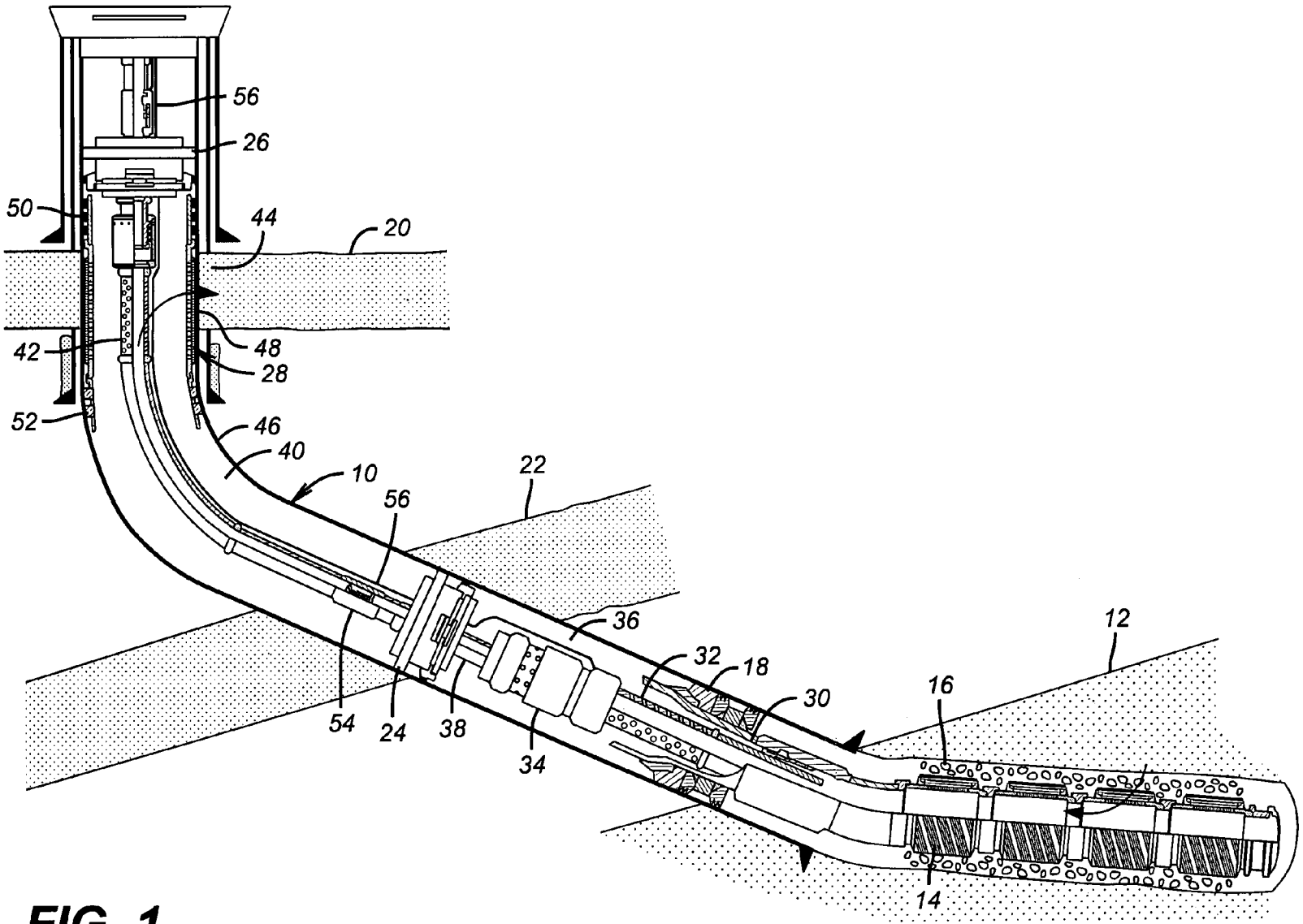
FIG. 1 is a section view of a well with a lower water producing zone and injection through the valve of FIG. 1 in an upper injection zone.

Referring to FIG. 1, a wellbore 10 has a water-producing zone 12. A series of screens 14 are gravel packed 16 in a known manner to keep sand from reaching the screens 14 when the water is produced into the wellbore 10. Packer 18 isolates the water-producing zone 12 from the injection zone 20. In FIG. 1 zone 22 is effectively isolated from the wellbore by solid casing and from the produced water by the positioning of packers 24 and 26 and the location of injection tube 28, as will be explained below.

Packer 18 preferably has a polished bore receptacle 30 into which a perforated stinger pipe 32 is inserted. A downhole pump 34 takes suction from stinger 32 and the surrounding annular space 36 between packers 18 and 24. The pressurized discharge from pump 34 enters the discharge line 38 that passes through packer 24 with suitable seals (not shown). The pressure in line 38 pressurizes annulus 40 because line 38 has openings 42 just below packer 26. Flow is forced through an opening 44 in casing 46. Mounted over opening 44 is an injector pipe 48 having upper and lower seals 50 and 52 against the casing 46. Packer 26 prevents flow from annulus 40 from going further uphole. A check valve 54 is mounted in the discharge line 38. Power for pump 34 comes from cable 56 that extends to the surface through packers 24 and 26.

Figure 2:
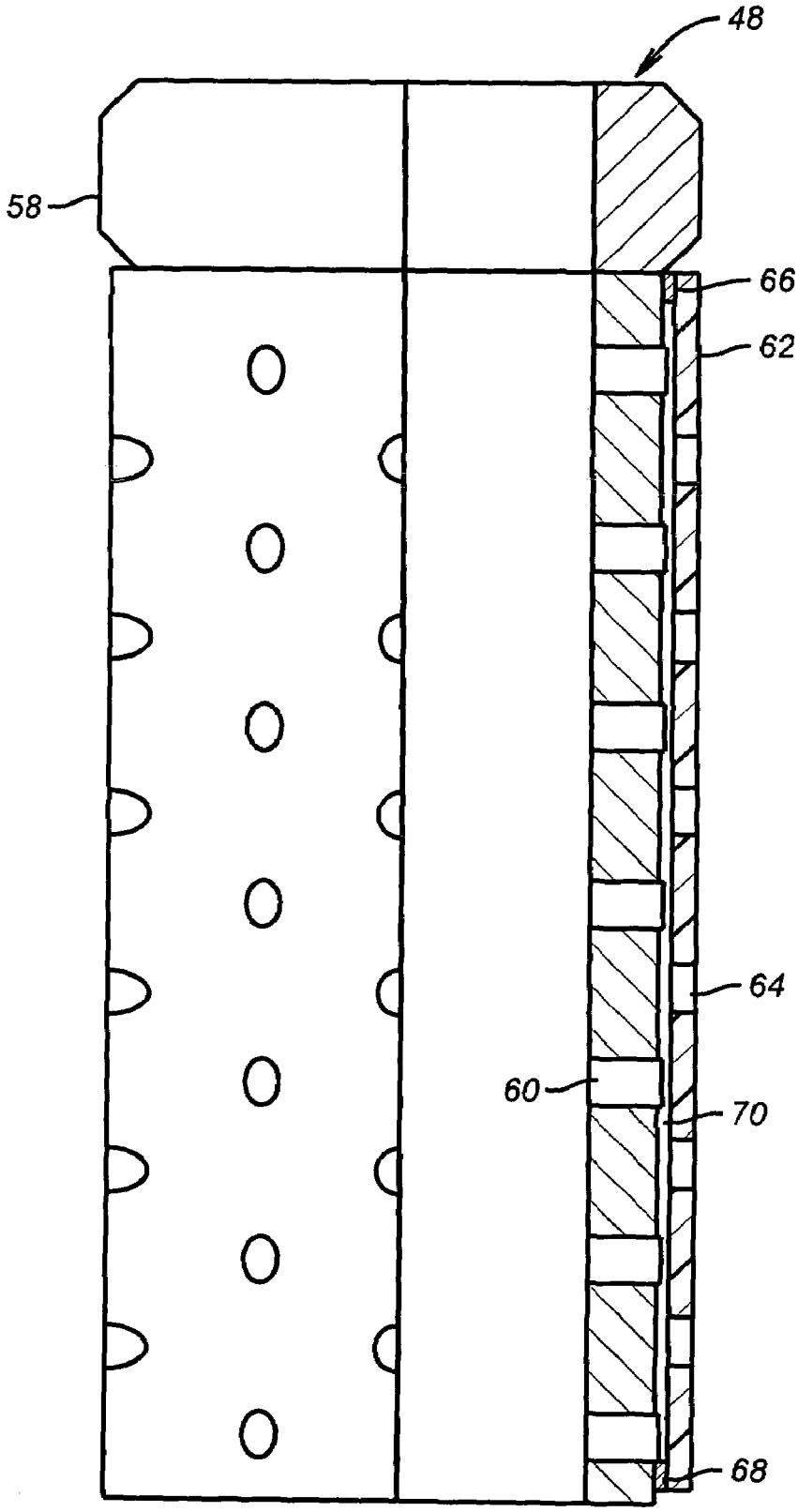
FIG. 2 is an elevation view partly in section of the injector valve in a closed position.

FIG. 2 illustrates the injection pipe 48 in more detail. A base pipe 58 has openings 60 along its length. The openings can be any shape and in any pattern or randomly placed. A sleeve 62 is placed over the base pipe 58. It too has openings 64 that are misaligned with openings 60. Openings 64 can be of any shape and distribution while still being positioned in misalignment with openings 60. Clearly the number and size of openings 60 and 64 are selected to limit pressure drop as fluid passed through with the further criteria that when pressurized fluid flow stops, the sleeve 62 will collapse against base pipe 58 to close off holes 60 against reverse flow into base pipe 58. To accomplish this, the sleeve 62 is preferably made of a resilient material such as an elastomer and sealed and secured at upper end 66 and lower end 68 to the base pipe 58. These seals can be accomplished by bonding sleeve 62 to base pipe 58. Sleeve 62 can be sized small enough to allow it to be placed over base pipe 58 with no clearance or a slight clearance 70 that can define a small gap. In the event reverse flow starts, the sleeve 62 will be pushed against the base pipe 58 to close the openings 60.

When the injection process is done, the injector pipe 48 can be sealed off or can be milled out and replaced with a production screen or a casing patch to close off opening 44 if no further access to zone 20 is required.

The advantages of the injector pipe 48 are that it is less prone to damage if there is sand entrained in the produced water delivered through it. Its structure allows for it to be expanded while maintaining the integrity of sleeve 62 and the offset relation between openings 60 and 64. Even if sand is present, the simple structure of the injection pipe 48 coupled with the fact that the fluid velocity is slowed in making two right angle turns to exit will tend to reduce the tendency of entrained solids to cause erosion of the openings 60 and 64. The material choices for the sleeve 62 can be many. The sleeve 62 can be a seamless cylinder, it can have a seam or it can be a scroll to minimize resistance to expansion and any tendency to tear when expanding. The seam can be longitudinal or oriented spirally. Fixation at opposed ends above the perforated portion is preferred to facilitate flexing of sleeve 62 away from base pipe 58 in a manner that reliably assures that they will not fully separate. This promotes the sleeve 62 snapping back to the FIG. 2 position after being pushed away from base pipe 58 due to pressure developed from pump 34. Additionally, the onset of any reverse flow from the injection zone 20 will aid movement of the sleeve 62 back toward base pipe 58 for sealing off openings 60.

While an application of producing injection fluid from one zone and pumping it into another zone in the same wellbore is illustrated, those skilled in the art will appreciate that other applications for the injection valve 48 are possible. It can be used as a one-way valve to deliver gravel or acidizing chemicals into the well. It can also be used as a casing valve in: a variety of applications. The ability to expand the injector valve 48 into position allows it to be used in place of a screen and to eliminate gravel packing. It also promotes a large drift diameter for moving other downhole tools through it for operations further downhole.

Figure 3:
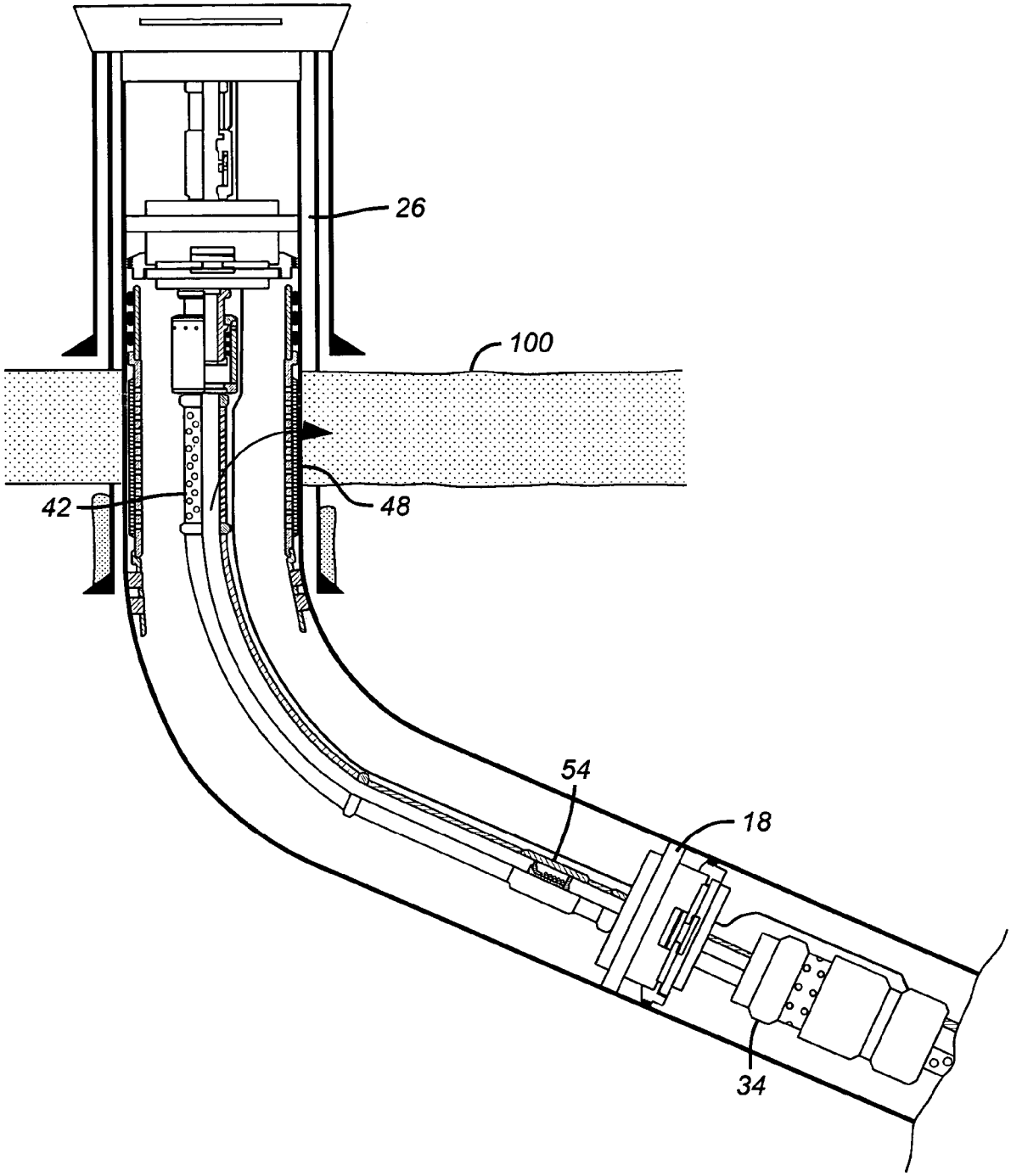
FIG. 3 is an alternative configuration to FIG. 1.

FIG. 3 illustrates a single injection zone 100 isolated by packer 18 from the water-producing zone, not shown. Pump 34 delivers the produced fluid through the packer 18 to annular space 40 that is closed off from the surface by packer 26. Injector pipe 48 allows the pumped fluid that has passed through perforated pipe 42 to enter the formation 100.

Figure 4:
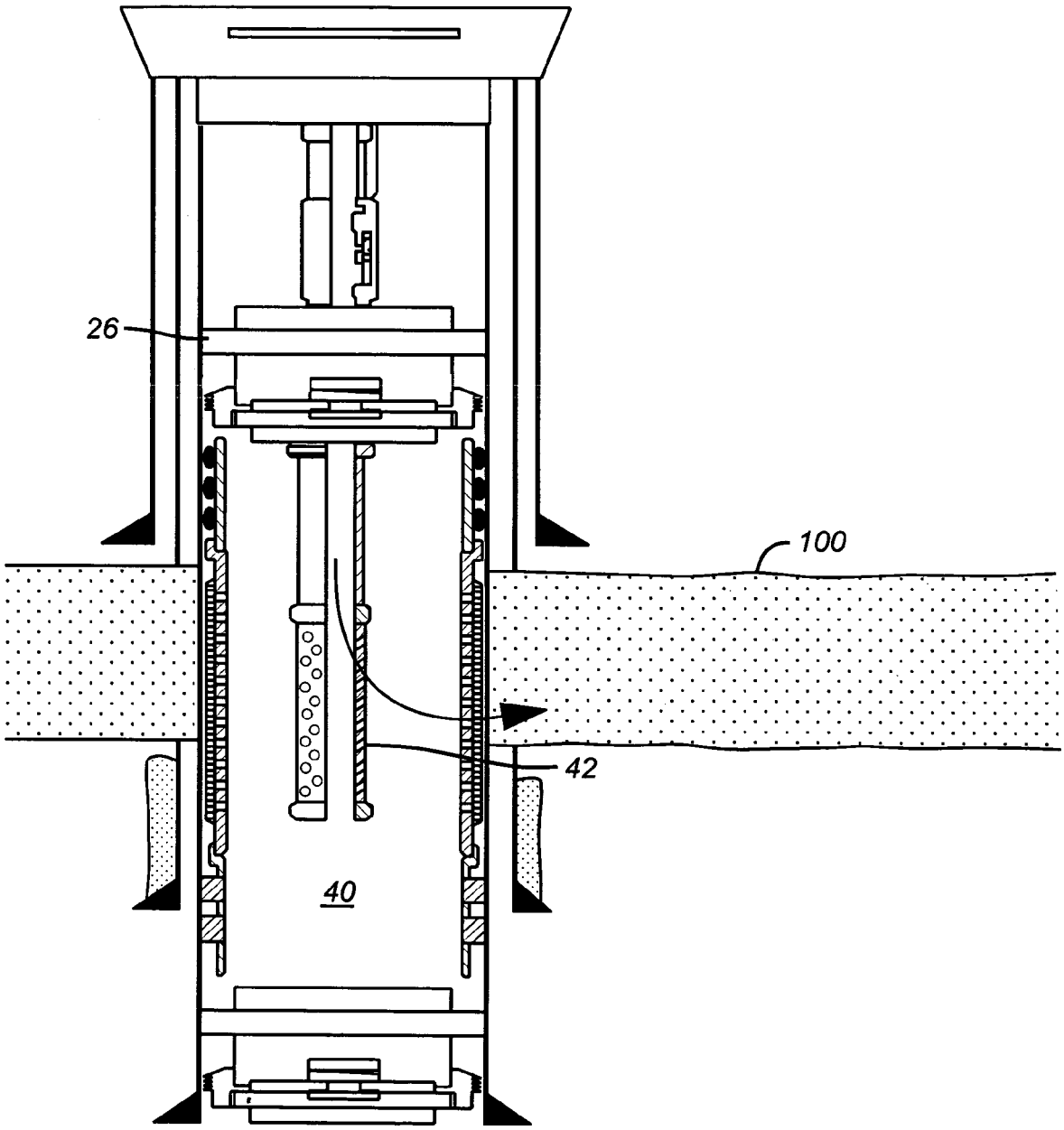
FIG. 4 is an alternative configuration to FIG. 1.

FIG. 4 shows a traditional surface injection through packer 26 through optional perforated pipe 42 and then through injector pipe 48. A packer such as 24 or the well bottom is used to allow pressure buildup in annular space 40 to force the fluid into the injection zone 100.

It is to be understood that this disclosure is merely illustrative of the presently preferred embodiments of the invention and that no limitations are intended other than as described in the appended claims.

I claim:

1. A valve for downhole use comprising:

a tubular body defining an interior passage and formed having at least one first opening thereon;

a valve member mounted to said body and moveable with respect to said body and said valve member further comprising at least one second opening thereon;

said valve member functional for movement with respect to said body in response to pressure applied and removed in said passage for selective flow and blockage of flow between said first and second openings;

said valve member remaining functional during radial expansion of said tubular.

2. The valve of claim 1, wherein:

said first and second openings remain misaligned even when flow is possible through them.

3. The valve of claim 1, wherein:

said valve member is mounted to said tubular body outside said passage.

4. The valve of claim 3, wherein:

said valve member is made of a resilient material.

5. The valve of claim 4, wherein:

said valve member is sealingly secured to said body adjacent an upper and lower end of said valve member.

6. The valve of claim 5, wherein:

said valve member flexes away from said valve body responsive to pressure within said passage to create a flowpath from said passage and through said first and second openings.

7. The valve of claim 6, wherein:

said first and second openings remain misaligned despite said flexing of said valve member.

8. The valve of claim 4, wherein:

said first opening comprises a plurality of first openings and said second opening comprises a plurality of second openings;

said valve member is made of rubber.

9. A method of regulating flow between a formation and a tubular string in a wellbore comprising:

providing a rigid valve body as part of the tubular string with at least one first opening from a passage therethrough;

providing a valve member on said valve body with said valve member having at least one second opening thereon;

expanding said rigid valve body by increasing the dimension of said passage therein;

selectively creating and closing a flowpath through said first and second openings after said expanding in response to pressure application and removal within said valve body.

10. The method of claim 9, comprising:

maintaining said openings in misalignment even while flow between them is possible.

11. The method of claim 9, comprising:

mounting said valve member around said valve body.

12. The method of claim 9, comprising:

forming said valve member as a sleeve.

13. The method of claim 9, comprising:

creating said flowpath by pressurizing from within said body.

14. The method of claim 13, comprising:

blocking said flowpath when formation pressure exceeds tubular string pressure.

15. A method of regulating flow between a formation and a tubular string in a wellbore comprising:

providing a valve body as part of the tubular string with at least one first opening;

providing a valve member on said valve body with said valve member having at least one second opening thereon;

expanding the valve body;

selectively creating and closing a flowpath through said first and second openings after said expanding in response to pressure application and removal within said valve body;

flexing the valve member after said expanding to selectively allow flow between said openings.

16. The method of claim 15, comprising:

sealingly securing said valve member to said valve body adjacent opposed ends of said valve member.

17. A method of regulating flow between a formation and a tubular string in a wellbore comprising:

providing a valve body as part of the tubular string with at least one first opening;

providing a valve member on said valve body with said valve member having at least one second opening thereon;

expanding the valve body;

selectively creating and closing a flowpath through said first and second openings after said expanding in response to pressure application and removal within said valve body;

making said valve member of a resilient material.

18. The method of claim 17, comprising:

making said resilient valve member out of rubber.

19. A method of regulating flow between a formation and a tubular string in a wellbore comprising:

providing a valve body as part of the tubular string with at least one first opening;

providing a valve member on said valve body with said valve member having at least one second opening thereon;

expanding the valve body;

selectively creating and closing a flowpath through said first and second openings after said expanding in response to pressure application and removal within said valve body;

forming said valve member as a scroll.

20. A method of regulating flow between a formation and a tubular string in a wellbore comprising:

providing a valve body as part of the tubular string with at least one first opening;

providing a valve member on said valve body with said valve member having at least one second opening thereon;

expanding the valve body;

selectively creating and closing a flowpath through said first and second openings after said expanding in response to pressure application and removal within said valve body;

providing a plurality of bends in said flowpath.

* * * * *